United States Patent [19]

Whitacre

[11] Patent Number: 5,052,161

[45] Date of Patent: Oct. 1, 1991

[54] TILE APPLICATION STRUCTURE

[76] Inventor: Daniel C. Whitacre, 1827 Wales Rd., N.E., Massillon, Ohio 44646

[21] Appl. No.: 433,656

[22] Filed: Nov. 8, 1989

[51] Int. Cl.[5] ..... E04F 13/08

[52] U.S. Cl. ..... 52/385; 52/386; 52/389; 52/390; 52/392

[58] Field of Search ..... 52/385, 386, 388, 389, 52/390, 392, 169.5

[56] References Cited

U.S. PATENT DOCUMENTS

| | | | |
|---|---|---|---|
| 566,489 | 8/1896 | Wilmot | 52/390 |
| 1,919,354 | 7/1933 | Anderson | 52/390 X |
| 2,031,680 | 2/1936 | Tuthill | 52/389 X |
| 3,533,896 | 10/1970 | Hartig | 52/390 X |
| 3,654,765 | 4/1972 | Healy et al. . | |
| 3,685,228 | 8/1972 | Pauley | 52/386 X |
| 3,802,790 | 4/1974 | Blackburn . | |
| 3,969,851 | 7/1976 | Whitacre . | |
| 4,128,982 | 12/1978 | Weaver | 52/389 X |
| 4,783,941 | 11/1988 | Loper et al. | 52/385 X |
| 4,840,515 | 6/1989 | Freese | 52/169.5 X |
| 4,890,433 | 1/1990 | Funaki | 52/385 X |
| 4,923,733 | 5/1990 | Herbst | 52/380 X |
| 4,943,185 | 7/1990 | McGuckin | 52/169.5 X |
| 4,956,951 | 9/1990 | Kannankeril | 52/169.14 X |

FOREIGN PATENT DOCUMENTS

| | | | |
|---|---|---|---|
| 143447 | 8/1980 | German Democratic Rep. | 52/388 |
| 107188 | 9/1965 | Norway | 52/169.5 |

OTHER PUBLICATIONS

Handbook for Ceramic Tile Insulation, 1988, Cover and p. 12, Pub. by Tile Council of America.

CPE-Waterproof Isolation Membranes for Ceramic Tile Systems, 8 pp.-Pub. by the Noble Company, 1985.

*Primary Examiner*—David A. Scherbel
*Assistant Examiner*—Deborah McGann Ripley
*Attorney, Agent, or Firm*—Oldham & Oldham Co.

[57] ABSTRACT

The flooring structure herein comprises a rigid base or substrate (typically wood or concrete), an outer course of ceramic tile or other fracturable material, a high impact strength crack isolation sheet interposed between the base and the tiles. The crack isolation sheet is a thin rectangular sheet, typically of plastic material such as high impact polystyrene, having a flat base portion and a plurality of dimples arranged in a regular geometric pattern and projections extending in one direction (i.e., upwardly) from the base portion. Both the base portion and the projections have holes. The base portion of the crack isolation sheet is adhesively bonded to the base or substrate. A substantially incompressible compression bed material, e.g., mortar or concrete, fills the space between the crack isolation sheet and the tiles but not the space beneath the projections of the crack isolation sheet. The latter space is essentially an unfilled air space. More than one crack isolation sheet may be required for an installation, in which case sheets are overlapped along their edges so that such sheets cover substantially the entire area of the installation.

17 Claims, 3 Drawing Sheets

TILE APPLICATION STRUCTURE

TECHNICAL FIELD

This invention relates to floor structures in which a hard surface material that can be fractured or cracked is bonded to a substrate. More particularly, this invention relates to floor structures or systems comprising ceramic tile bonded to a substrate or sub-floor.

BACKGROUND ART

Prior to and shortly after World War II, most commercial and residential floor tile installations utilized "mud setting" beds. These beds were composed of a lean mixture of sand and cement, placed fairly dry and generally not bonded to the floor base surface. Typically the mud setting bed was separated from the base of 15 pound roofing felt or the like. Tiles were fairly thick, e.g. about ¾" to 2" thick, and the mud beds were generally in the range of about 1-¼" to 1-½" thick. The same basic systems were used for terrazzo flooring.

Since the flooring systems were not bonded to the base, the base was free to move laterally with respect to the rest of the system. While this created some problems, it also offered the significant advantage that both the tile and the base (when a concrete base was used, which was typical) were protected from cracking. Shear forces caused by horizontal movement of the base were not transferred to the top finished surface. In addition, the very thickness of the system permitted a transfer of impact loads to dissipate to minimal levels prior to reaching the base level.

While flooring systems as above described were long lived and protected tiles from cracking, they were costly and heavy, and tile installations of this type were not easily coordinated with installations of carpet or vinyl floor covering.

Beginning in the early 1950's, the thick tile floor systems described above gave way to thin set systems, utilizing much thinner tiles, rarely over ½" thick, which frequently were direct-bonded to a concrete or wood substrate. Flooring systems of this type are less costly, lighter, and are more easily coordinated with installations of carpet or vinyl flooring. However, direct bonding of hard surface materials to a hard solid substrate, either concrete or wood, has caused problems. Concrete shrinks. Wood expands and contracts. These dimensional changes in the substrate transmit forces to the surface finish, whether tile or terrazzo, causing the direct bonded tile or terrazzo to crack.

The problem of cracking can be solved relatively easily when a wooden base or substrate is used. One simply nails expanded metal lath to the wooden base. Installations of this type have been in use for some 20 years, and give fairly good protection against cracking to the surface finish material. This solution is not readily applied to systems having a concrete base, however. It is difficult and expensive to "nail", i.e. mechanically affix lath to concrete. Various solutions to the cracking problem have been proposed. Basically, these involve the placement of a thin membrane between the concrete base and the tile. There are two basic types of such membranes: those which are solid when applied, and those which are liquid when applied. The former emanate primarily from the roofing industry, and comprise a soft plastic, in some cases elastomeric, material in thin sheet form. The liquid applied membranes dry to a soft solid. These membranes will absorb the horizontal movement of concrete and tile. However, they dramatically lower impact resistance. As a result, tiles and terrazzo are easily broken by workers' tools, wheel loads, or any other localized high stress. In short, significant tile cracking problems remain.

DISCLOSURE OF THE INVENTION

Applicant has found that the problem of cracking of tile, terrazzo or other hard fractural surface finish layers is virtually eliminated by placing a thin plastic sheet having dimples or projections thereon between the base (either concrete or wood) and the surface finish layer of a thin floor system of the type described, and adhering this plastic sheet to the base by means of an adhesive that permits long term horizontal movement to take place.

This invention provides a building structure comprising: an essentially rigid coherent base; an outer course comprising hard coherent fracturable material spaced from and generally parallel to said base; and a crack isolation sheet interposed between said base and said outer course, said sheet being made of an impact resistant material and comprising a thin flat base sheet portion having opposite surfaces and a plurality of regularly spaced hollow projections extending from one of said surfaces, said projections being of substantially equal height, the other surface of said base sheet being adhesively bonded to said base, said projections extending toward said outer course; and means bonding said outer course to said crack isolation sheet and said base to form a unitary structure.

BEST MODE FOR CARRYING OUT THE INVENTION

This invention will now be described with particular reference to the best mode and preferred embodiment of the invention.

The building structure or system of this invention is primarily useful as a flooring installation, and will be described with particular reference thereto.

Figure 1:
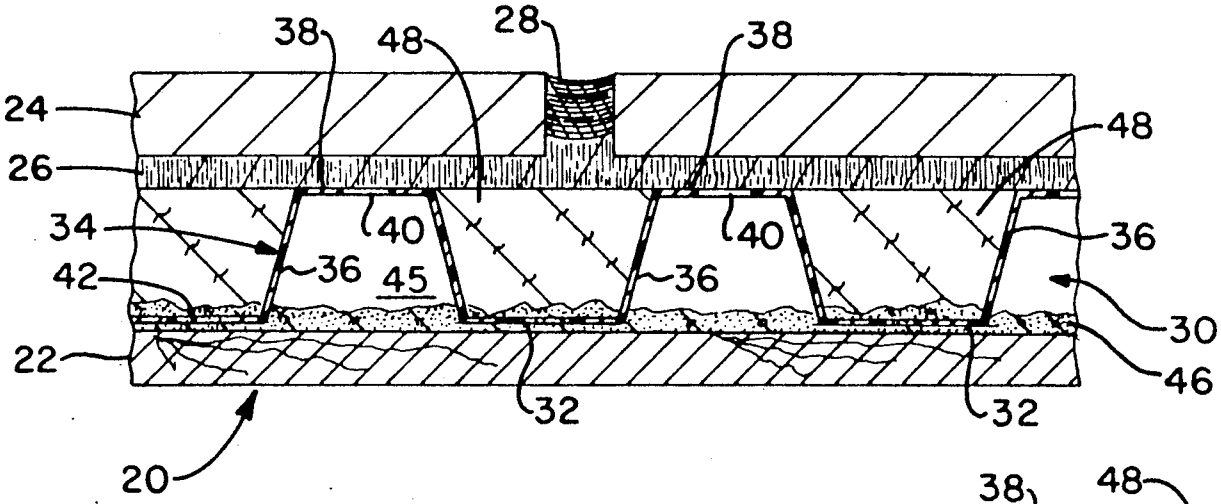
FIG. 1 is a vertical sectional view of a floor structure according to this invention.
Figure 2:
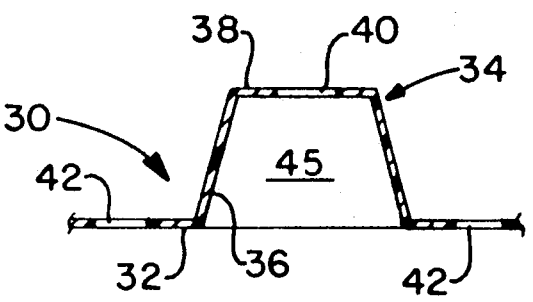
FIG. 2 is a vertical sectional view of a portion of the crack isolation sheet shown in FIG. 1.

Referring now to FIG. 1, a building structure or system 20 of this invention comprises a rigid coherent base 22, e.g. wood or concrete; and an outer course or facing layer of ceramic tiles 24 which are cemented together by means of a mortar layer 26 applied to the underside of the tiles and grout 28 in the spaces between adjacent tiles. Conventional materials may be used for mortar 26 and grout 28. The tiles 24 form the outer or walking surface of the structure.

Figure 7:
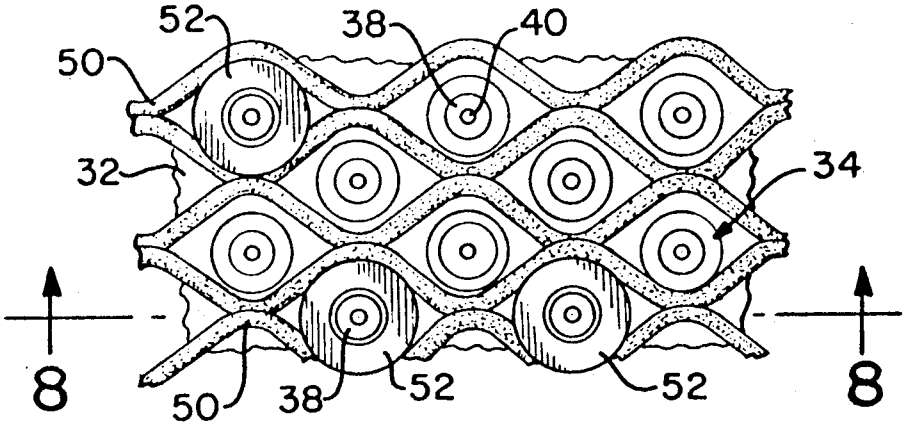
FIG. 7 is a plan view of a flooring installation according to this invention which utilizes expanded metal lath.
Figure 6:
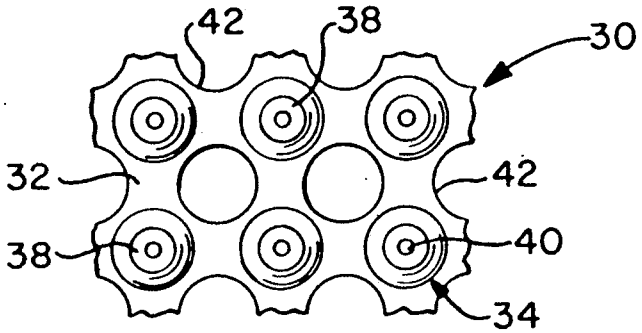
FIG. 6 is a plan view of a crack isolation sheet according to another embodiment of this invention.

Interposed between the base 22 and the outer course 24 is a thin deformable rectangular crack isolation sheet 30, which is preferably made of a high impact strength thermoplastic material such as high impact polystyrene. Such a sheet is shown in FIGS. 1 and 6. This crack isolation sheet 30 comprises a thin, essentially planar base or back portion 32 having opposite surfaces, and a plurality of frustoconical dimples or projections 34 which extend from one of said surfaces, i.e. away from the base 22 (upwardly in a floor system). Each of these projections 34 has a frustoconical sidewall portion 36 and an essentially planar outer or top wall portion 38 having a central hole 40 therein. The projections 34 may be arranged in any desired regular geometric pattern, either square as shown in FIG. 6, or triangular as shown in FIG. 7. In both the square and the triangular patterns, the dimples 34 are arranged in a plurality of equally spaced parallel rows, with equal spacings (center to center) between adjacent dimples in the same row. The base sheet portion 32 also has a plurality of holes 42 arranged in a regular geometric pattern. The projections 34 may be arranged in any desired regular geometric pattern, either square as shown in FIG. 6, or triangular as shown in FIG. 7.

Figure 3:
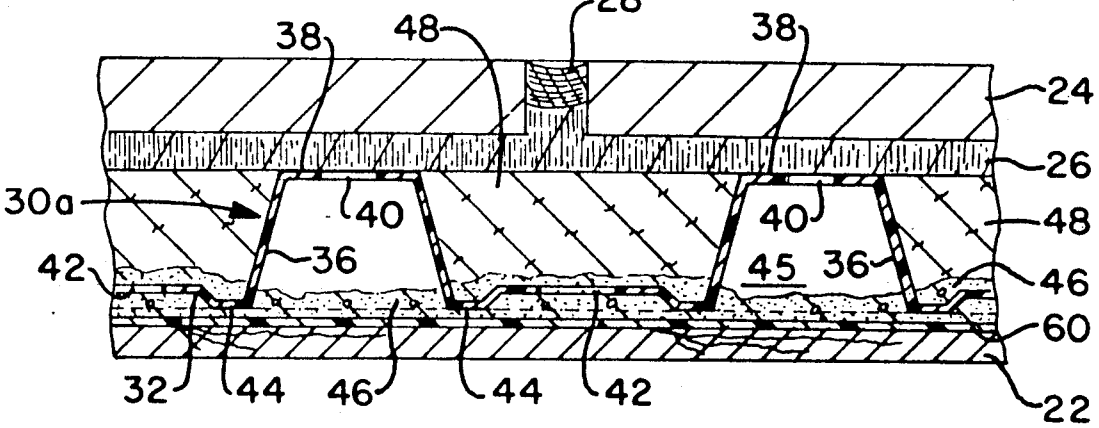
FIG. 3 is a vertical sectional view of a floor structure employing a modified form of crack isolation sheet according to a second embodiment of this invention.
Figure 4:
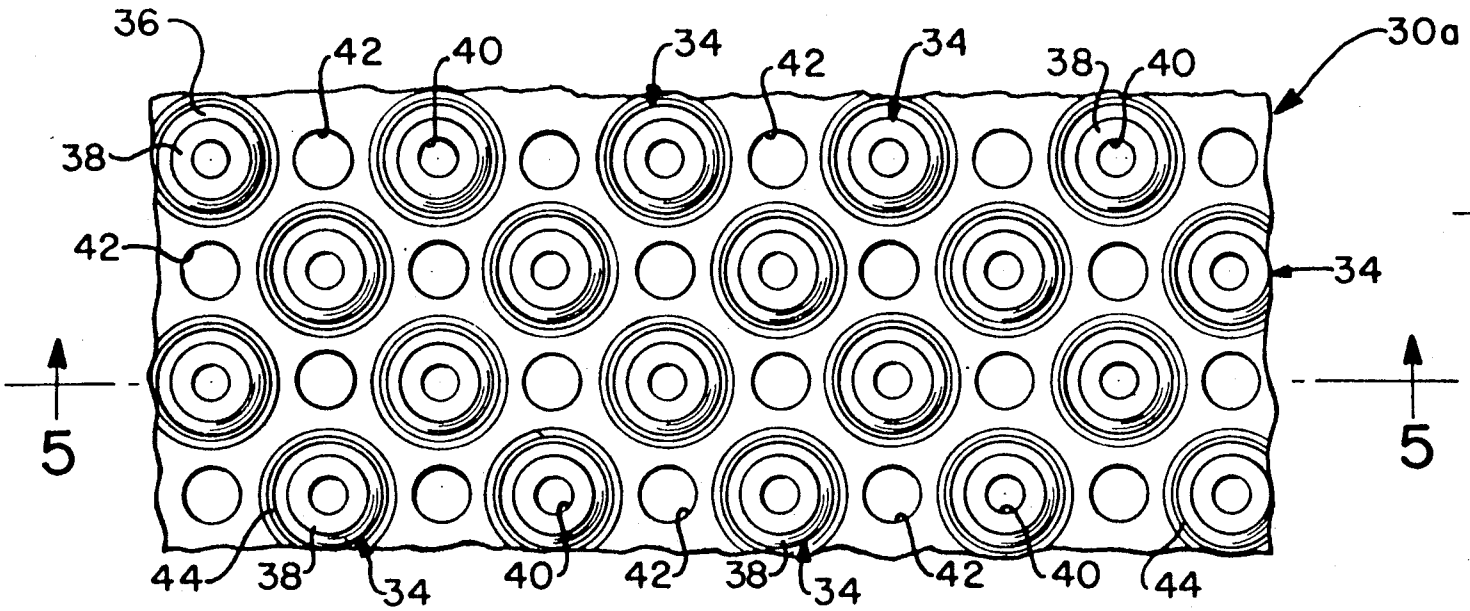
FIG. 4 is a plan view of a crack isolation sheet according to a preferred embodiment of this invention.
Figure 5:
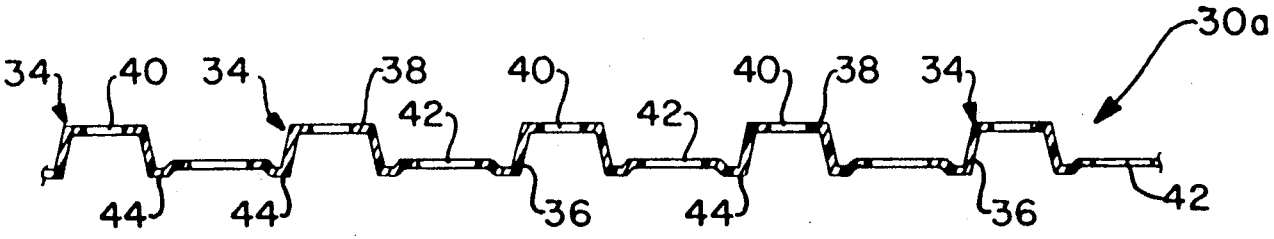
FIG. 5 is a vertical sectional view taken along line 5—5 of FIG. 4.

A modified form of crack isolation sheet 30*a*, shown in FIGS. 3, 4 and 5 has annular recesses 44 surrounding the projections 34 and extending inwardly, i.e. in a direction opposite that of the projections. Otherwise sheet 30*a* is like sheet 30.

For maximum protection against spreading of cracks, the base diameter of dimples 34 (which are of uniform diameter) should be equal to or greater than one quarter the distance (center to center) between adjacent dimples. Usually the base diameter is from one-quarter to one-half the distance between adjacent dimples.

The height of projections 34 may range from about 3/16 inch (0.19 inch, or approximately 0.5 cm) to about ½ inch (0.5 inch, or approximately 1.3 cm). The thickness of sheet 30 is about 10 to about 20 mils (0.010 to 0.020 inch, or about 0.25 to about 0.5 mm). The space beneath projections 34 (between the base 22 and the outer wall 38 of the projections) is free space or dead air space 45, except for a small amount of mortar and adhesive that may enter this space.

Crack isolation sheet 30 may be bonded to the base 22 by means of a suitable adhesive, preferably one which permits relative lateral movement (horizontal movement in the case of a floor installation) between the crack isolation sheet 30 and the base 22. A layer 46 of such adhesive is applied to one surface of the base 22. The base portion 32 of crack isolation sheet 30 or 30*a* is embedded in this adhesive layer 46, as shown in FIGS. 1 and 3.

A compression bed 48 of essentially incompressible material having high compression strength fills the space surrounding projections 34 and between the crack isolation sheet 30 and the mortar layer 26. This compression bed material is preferably a cementitious mortar, as for example, a mortar sold under the trademark "Sikatop 121" by Sika Corporation. The mortar has a 7-day/28-day bond strength rating of 7600/8200 psi. The space beneath dimples 34 is unfilled air space except for small hubs of mortar 26 in the immediate vicinity of holes 40. Cementitious materials and certain epoxies and vinyl resins fulfill these requirements.

Figure 8:
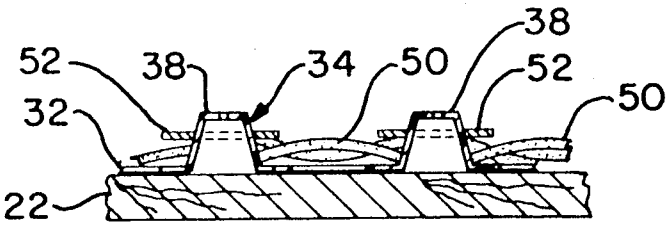
FIG. 8 is a vertical sectional view taken along line 8—8 of FIG. 7.

An expanded metal lath 50, shown in FIGS. 7 and 8, may be provided in the space between the base 22 and the outer course 24, and more particularly between the base sheet portion 32 of crack isolation sheet 30 and the mortar layer 26. This expanded metal lath 50 gives further protection against the transmission of forces which might cause either the tile 24 or the base 22 (when a concrete base is used) to crack. This metal lath is not necessary in most instances. When this metal lath is used, the geometric configuration of the projections 34 on the base sheet 30 must conform in arrangement and spacing to the holes in the expanded metal lath, as is apparent from FIG. 7. A metal wire mesh, typically having square openings, may be used instead of expanded metal lath.

Annular lock washers 52, typically of either an elastomeric material (e.g., rubber) or metal (e.g., aluminum or stainless steel) may be placed around the dimples 34 as shown in FIGS. 7 and 8. The inner diameter (or hole diameter) of these washers is intermediate between the base diameter and top diameter of dimples 34, so that they are disposed at positions intermediate between base portion 32 and the tops 38 of dimples 34. These washers hold the lath or wire lath in place so that it will lie flat during installation and placement of mortar. Washers 52 are also believed to help to dissipate stress laterally and thereby give additional crack protection to the concrete base 22.

A thin membrane (not shown), typically elastomeric, may be interposed between base 22 and crack isolation sheet 30. Such membrane further protects a concrete base 22 from cracking. Such membrane (when used) may be adhesively bonded to base 22 and to crack isolation sheet 30. Suitable adhesives are those previously indicated as suitable for adhesive cover 46, e.g., mastics.

Conventional ceramic floor tiles are preferably used in the practice of this invention. Alternatively, terrazzo may be used. It is possible to use thin slabs of concrete in place of tile or terrazzo if desired. Concrete usually does not present as good an external appearance as tile or terrazzo, but is lower in cost. Use of concrete is most desirable when the structure of this invention is to be covered with a floor covering, e.g. a carpet or a vinyl floor covering.

Crack isolation sheet 30 is a unitary sheet of the type (except for holes 40 and 42 and recesses 44) hitherto used in wall drainage systems, but not in flooring systems. Sheet 30 is formed of a high impact strength thermoplastic material, preferably high impact polystyrene, although other thermoplastic materials such as ABS (acrylonitrile-butadiene-styrene), polyethylene may be used. The thickness of sheet 30 may be about 5 to about 10 mils (i.e. about 0.005 to about 0.010 inch). This sheet may be formed by conventional injection molding or sheet forming techniques. The sheet is formed in rectangular pieces of predetermined dimension. When a given flooring installation requires more than one sheet 30, which is usually the case, each sheet may overlap with the adjacent sheets along its edges with the projections 34 closest to the respective edges of the two adjacent sheets in nesting relationship. This gives a double sheet thickness at the edges. It is desirable to avoid treble and quadruple sheet thicknesses and this may be done by cutting away the corners of all except two overlapping sheets. The sheet or sheets 30 (or substantially the entire area (as seen in plan view) of the installation and this may be done by cutting away the corners of all except two overlapping sheets. Projections 34 provide air pockets in the complete structure or system of this invention, since the space under these projections is free space, except for a small amount of mortar 26 and adhesive 46 that may enter this space.

The adhesive layer 46 is a material which will permit some lateral long-term movement or slippage of the crack isolation sheet 30 and outer course 24 (which are firmly bonded to each other) with respect to the base 22. In addition, this adhesive, or mastic, should be waterproof. The adhesive should have adequate initial tack to hold sheet 30 in place which the adhesive is curing, adequate long term expansion characteristics, and compatibility with and bonding to system components. Typically the adhesive is solvent based, and is applied in liquid form and allowed to dry. The solvent of a solvent based adhesive must not be one which dissolves the polymer which forms crack isolation sheet 30. Most of the suitable adhesives are either rubber based or polyurethane based. Various suitable adhesives are commercially available.

Building structures according to the present invention prevent both a concrete base 22 and tiles 24 from cracking due to stresses transmitted through the structure, except possibly in cases of unusually high stress or shock. The dimples or projections 34 provide a screed bed and dissipate stresses by providing numerous stress crack points and permitting minute cracks, approximately ¼ to 5/16 inch long to develop. The existence of a dead air space beneath the projections 34 is highly important to this stress dissipation. The structure of the present invention therefore provides the economies, light weight and ease of installation which characterizes modern floor tile systems, (i.e. those in use since the 1950's) while affording a degree of protection to the tiles which was characteristic of older floor tile systems but not found in modern tile systems.

Isolation joints (not shown) should be provided at building walls, pipe interruptions through the floor, or at any location where an item is fixed to the floor, in order to permit a structure or installation according to this invention to "float" independent of building shrinkage, expansion or other movement.

Floor structures according to this invention are suitable for both new construction and renovations. In the latter case, the existing floor may constitute the base 22 of the installation.

While in accordance with the patent statutes, a preferred embodiment and best mode has been presented, the scope of the invention is not limited thereto, but rather is measured by the scope of the attached claims.

What is claimed is:

1. A building structure comprising (a) an essentially rigid coherent base;

(b) an outer course comprising hard coherent fracturable material spaced from and generally parallel to said base;

(c) a crack isolation sheet interposed between said base and said outer course, said sheet being made of an impact resistant material and comprising a thin flat base sheet portion having opposite surfaces, a plurality of regularly spaced hollow projections arranged in a regular geometric pattern which includes a plurality of rows and a plurality of spaced projections in each row, said projections extending from one of said surfaces, being of substantially equal height, the other surface of said base sheet being adhesively bonded to said base, said projections extending toward said outer course, and annular recesses surrounding said projections;

(d) means for bonding said outer course to said crack isolation sheet and said base to form a unitary structure; and (e) a layer of flexible adhesive material applied to said base and bonding said crack isolation sheet to said base, said adhesive material permitting lateral movement between said base and said crack isolation sheet.

2. A structure according to claim 1 wherein said base is concrete.

3. A structure according to claim 1 wherein said outer course comprises a plurality of tiles.

4. A structure according to claim 1 wherein said crack isolation sheet is a unitary sheet made of thermoplastic material.

5. A structure according to claim 1 wherein said thermoplastic material is high impact polystyrene.

6. A structure according to claim 1 wherein said projections are frustoconical.

7. A structure according to claim 6 wherein each of said frustoconical projections includes a side wall and an outer wall, and wherein said outer wall has a central opening therein.

8. A structure according to claim 1 wherein said base sheet portion of crack isolation sheet comprises a plurality of regularly arranged holes.

9. A structure according to claim 1 wherein at least part of the base sheet portion of said crack isolation sheet is embedded in said adhesive material.

10. A structure according to claim 1 further including a layer of mortar between said outer course and said crack isolation sheet.

11. A structure according to claim 10 wherein said outer course comprises a plurality of tiles with space between the edges of adjacent tiles, and wherein said mortar layer extends into said space.

12. A structure according to claim 10 further comprising a body of incompressible material in the space surrounding said projections and between said base sheet portion and said mortar layer.

13. A structure according to claim 12 further including a substantial free space volume beneath said projections.

14. A structure according to claim 1 wherein said crack isolation sheet also has a plurality of holes in said base sheet portion, said holes being arranged in a regular geometric pattern.

15. A structure according to claim 1, said structure being a flooring structure.

16. A structure according to claim 15 wherein said projections are frustoconical and the bse diameter of said projections is between adjacent projections.

17. A structure according to claim 15, said structure comprising a plurality of crack isolation sheets arranged in overlapping relationship and covering substantially the entire area.

* * * * *